US009013362B2

(12) United States Patent
Yang

(10) Patent No.: US 9,013,362 B2
(45) Date of Patent: Apr. 21, 2015

(54) OUTDOOR ANTENNA

(76) Inventor: Kendy Yang, Guangdong (CN)

( * ) Notice: Subject to any disclaimer, the term of this patent is extended or adjusted under 35 U.S.C. 154(b) by 429 days.

(21) Appl. No.: 13/450,202

(22) Filed: Apr. 18, 2012

(65) Prior Publication Data

US 2012/0200471 A1 Aug. 9, 2012

Related U.S. Application Data

(63) Continuation of application No. PCT/CN2010/070468, filed on Feb. 2, 2010.

(30) Foreign Application Priority Data

Oct. 19, 2009 (CN) ..... 2009 2 0237392 U

(51) Int. Cl.

| | |
|---|---|
| ***H01Q 19/02*** | (2006.01) |
| ***H01Q 19/30*** | (2006.01) |
| ***H01Q 1/08*** | (2006.01) |
| ***H01Q 1/12*** | (2006.01) |
| ***H01Q 19/04*** | (2006.01) |
| ***H01Q 19/10*** | (2006.01) |

(52) U.S. Cl.

CPC ..... *H01Q 19/30* (2013.01); *H01Q 1/08* (2013.01); *H01Q 1/1235* (2013.01); *H01Q 19/04* (2013.01); *H01Q 19/106* (2013.01)

(58) Field of Classification Search

CPC ..... H01Q 1/08; H01Q 1/12; H01Q 19/04
USPC ..... 343/833, 819, 878, 880, 881, 915
See application file for complete search history.

(56) References Cited

FOREIGN PATENT DOCUMENTS

| | | | | | |
|---|---|---|---|---|---|
| CN | 301173103 | S | | 4/2004 | |
| CN | 301173104 | S | | 4/2004 | |
| CN | 201327869 | Y | * | 10/2009 | ..... H01Q 1/12 |
| CN | 201327869 | Y | | 10/2009 | |
| CN | 201336367 | Y | | 10/2009 | |
| CN | 301039584 | S | | 10/2009 | |
| CN | 301039585 | S | | 10/2009 | |
| CN | 301067229 | S | | 11/2009 | |
| CN | 301104901 | S | | 1/2010 | |
| CN | 301117802 | S | | 1/2010 | |
| CN | 201450103 | U | | 5/2010 | |
| EP | 1199771 | A2 | | 4/2002 | |
| EP | 1199771 | A2 | * | 4/2002 | ..... H01Q 19/30 |
| EP | 2093836 | A1 | | 8/2009 | |

* cited by examiner

*Primary Examiner* — Robert Karacsony
*Assistant Examiner* — Michael Bouizza
(74) *Attorney, Agent, or Firm* — Muncy, Geissler, Olds & Lowe, P.C.

(57) ABSTRACT

The outdoor antenna includes multiple directors located respectively on a main rod and two assistant rods, and an inner-swing arm and an outer-swing arm fixed on the main rod and coupled with two ends of the assistant rods. When the inner-swing arm and the outer-swing arm are expanded, the assistant rods are fixed on two sides of the main rod; when the inner-swing arm and the outer-swing arm are folded, the assistant rods are positioned in parallel with the main rod. In use, the inner-swing arm and the outer-swing arm are expanded to allow the assistant rods to move toward the two sides of the main rod and maintain in a certain spatial distance to receive as many radio signals as possible. During transportation and storage, the assistant rods can lean against two sides of the main rod, so that occupied space is reduced to achieve usability.

8 Claims, 5 Drawing Sheets

OUTDOOR ANTENNA

This application is a continuation of International Application No. PCT/CN2010/070468 filed on Feb. 2, 2010, for which priority is claimed under 35 U.S.C. §120; and this application claims priority of Application No. 200920237392.8 filed in China on Oct. 19, 2009, for which priority is claimed under 35 U.S.C. §119, the entire contents of all of which are hereby incorporated by reference.

FIELD OF THE INVENTION

The present invention relates to an outdoor antenna.

BACKGROUND OF THE INVENTION

In the present techniques, an outdoor antenna generally includes a main rod and assistant rods with multiple directors located thereon in a perpendicular manner. To facilitate signal receiving, the main rod and assistant rods have to be spaced from each other at a selected spatial distance so that the directors can be distributed in a sufficient space. As a result, the entire outdoor antenna occupies a significant large space. This makes transportation and storage more difficult. In addition, the main rod and assistant rods are fastened through screws. Disassembly also is inconvenient. Moreover, there are also a plurality of mesh reflectors composed of metal bars and located on the main rod that are spaced form each other and distributed in a V shape. They also take a lot of space. All these create a lot of troubles in transportation and storage. The reflectors also are fastened to the main rod via screws, hence assembly and disassembly are cumbersome.

SUMMARY OF THE INVENTION

The primary object of the present invention is to provide an outdoor antenna consisting of elements that can be movably coupled.

To achieve the foregoing object, the outdoor antenna according to the invention includes a main rod, two assistant rods and multiple directors located respectively on the main rod and assistant rods. The assistant rods are respectively coupled with an inner-swing arm and an outer-swing arm at two ends thereof that are fastened to the main rod. When the inner-swing arm and outer-swing arm are expanded, the assistant rods are fixed at two ends of the main rod in a V shape. When the inner-swing arm and outer-swing arm are folded, the two assistant rods are positioned is parallel with the main rod.

The outer-swing arm also has side plates clamping two sides of the main rod. Each side plate is fastened to the outmost director on the main rod and can be swiveled about the director. The side plate has a latch hole. The main rod has two latch heads at one end thereof. When the outer-swing arm is expanded, the latch heads of the main rod drop into the latch holes.

The main rod is a square tube with an aperture on the side wall. The latch heads of the main rod are located at two ends of a first C-shaped elastic clip which is held in the square tube. The latch heads of the main rod are ejected outwards from inner sides of the apertures and exposed outside the square tube.

The inner-swing arm is fastened to one director at an inner end of the main rod and can be swiveled about the director.

The main rod also has a holding rack which holds a reflector. The reflector has a square tube with two latch heads. The holding rack has a square hole to hold the square tube and a side orifice on a side wall thereof to hold one latch head of the square tube. After the square tube is inserted into the square hole, the latch heads of the square tube are wedged in the side orifices.

The latch heads of the square tube are located at two ends of a second C-shaped elastic clip which is held in the square tube. The latch heads of the square tube are ejected outwards from the inner sides of the apertures.

The side plate has an inclined surface on an inner side leading to the latch hole.

Through the inner-swing arm and outer-swing arm, the two assistant rods can be fixed on the main rod and also can be moved against the main rod. When in use the inner-swing arm and outer-swing arm are expanded, the two assistant rods are moved against the main rod and spaced from each other at a selected spatial distance to receive as many radio signals as possible. During transportation and storage, the two assistant rods can be moved towards the main rod and lean on two sides of the main rod to reduce occupied space to facilitate transportation and storage.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
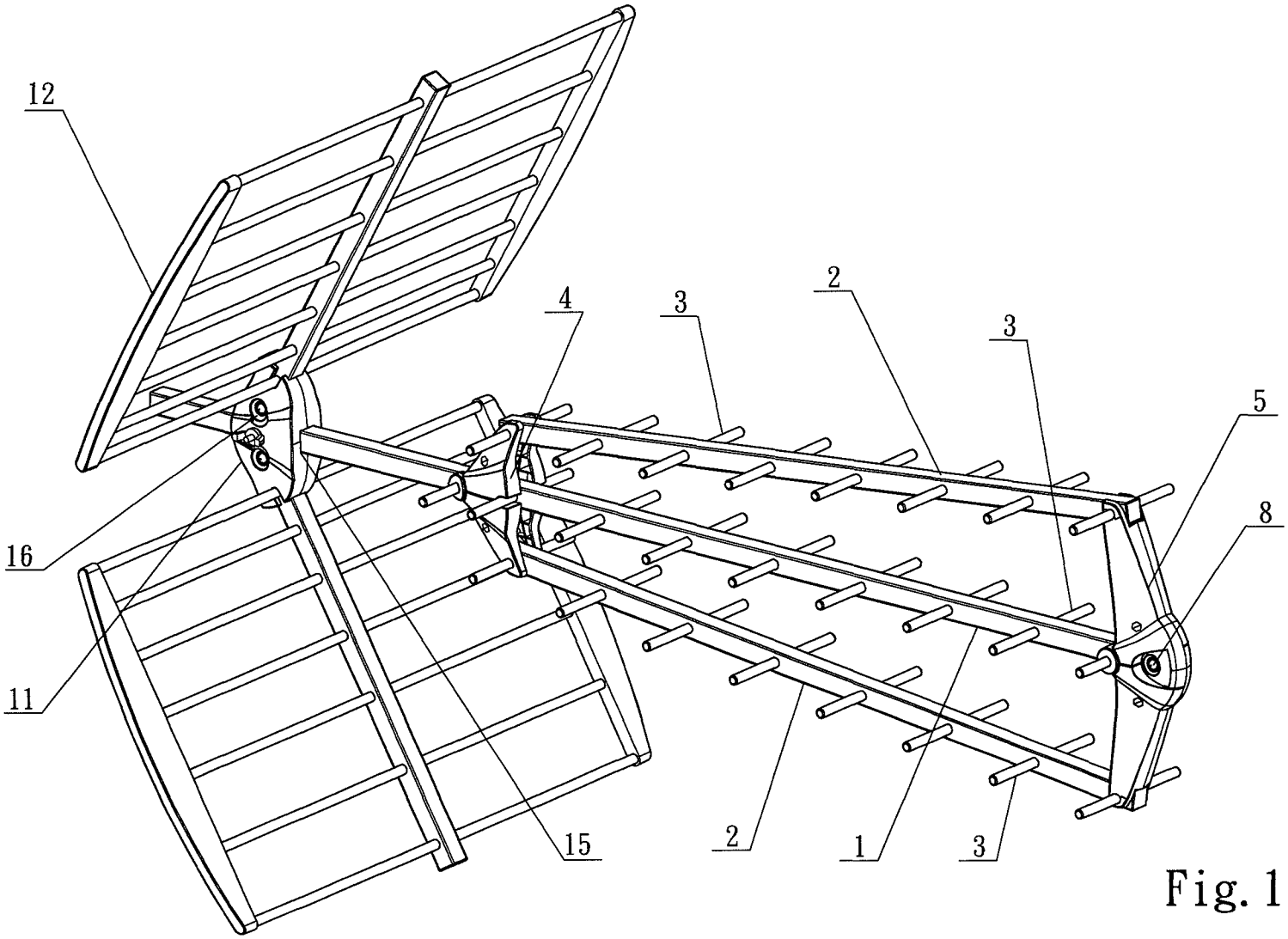
FIG. 1 is a perspective view of the outdoor antenna of the invention in an expanded condition.
Figure 2:
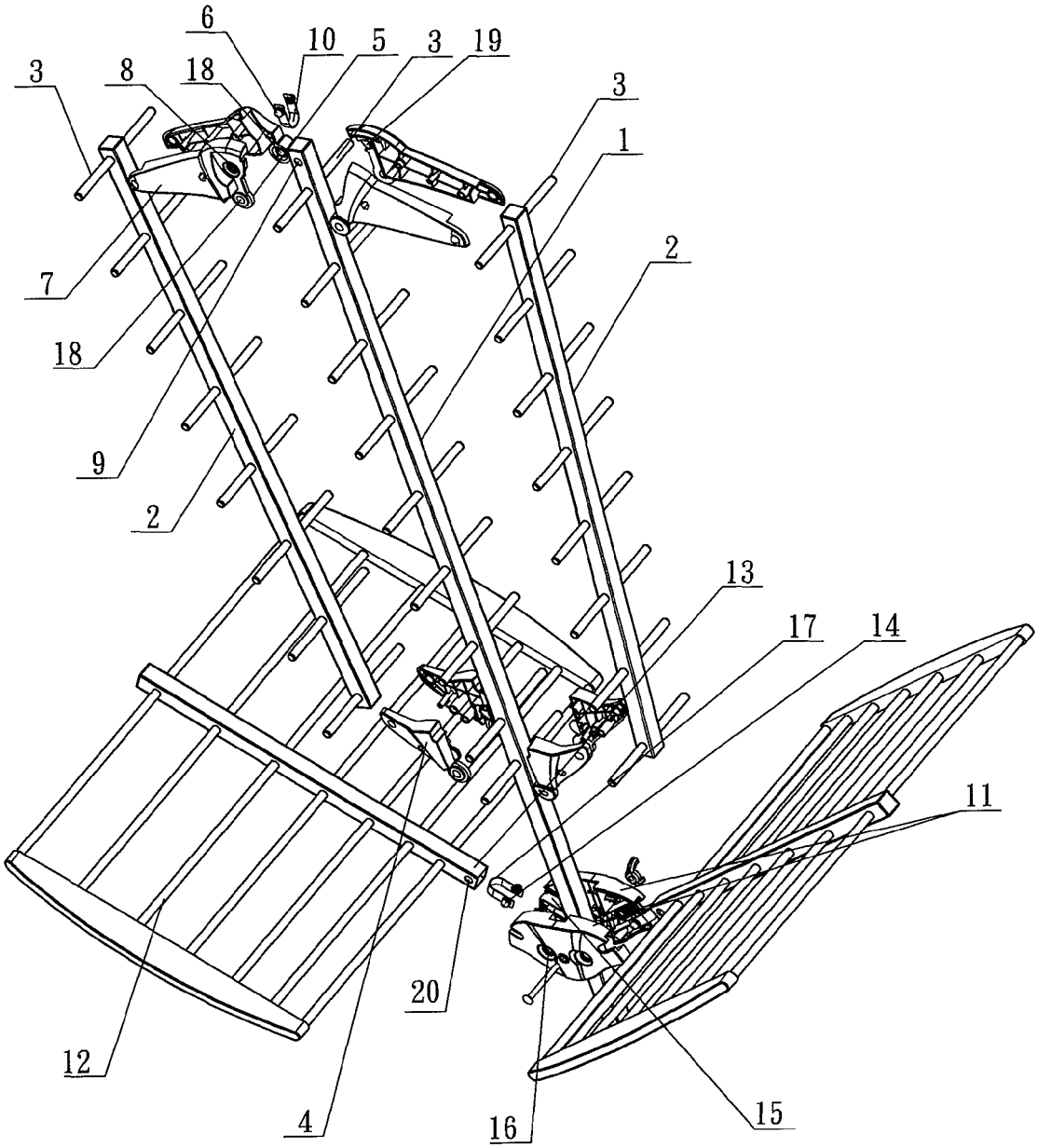
FIG. 2 is a perspective view of the outdoor antenna according to FIG. 1 in an assembled condition.
Figure 3:
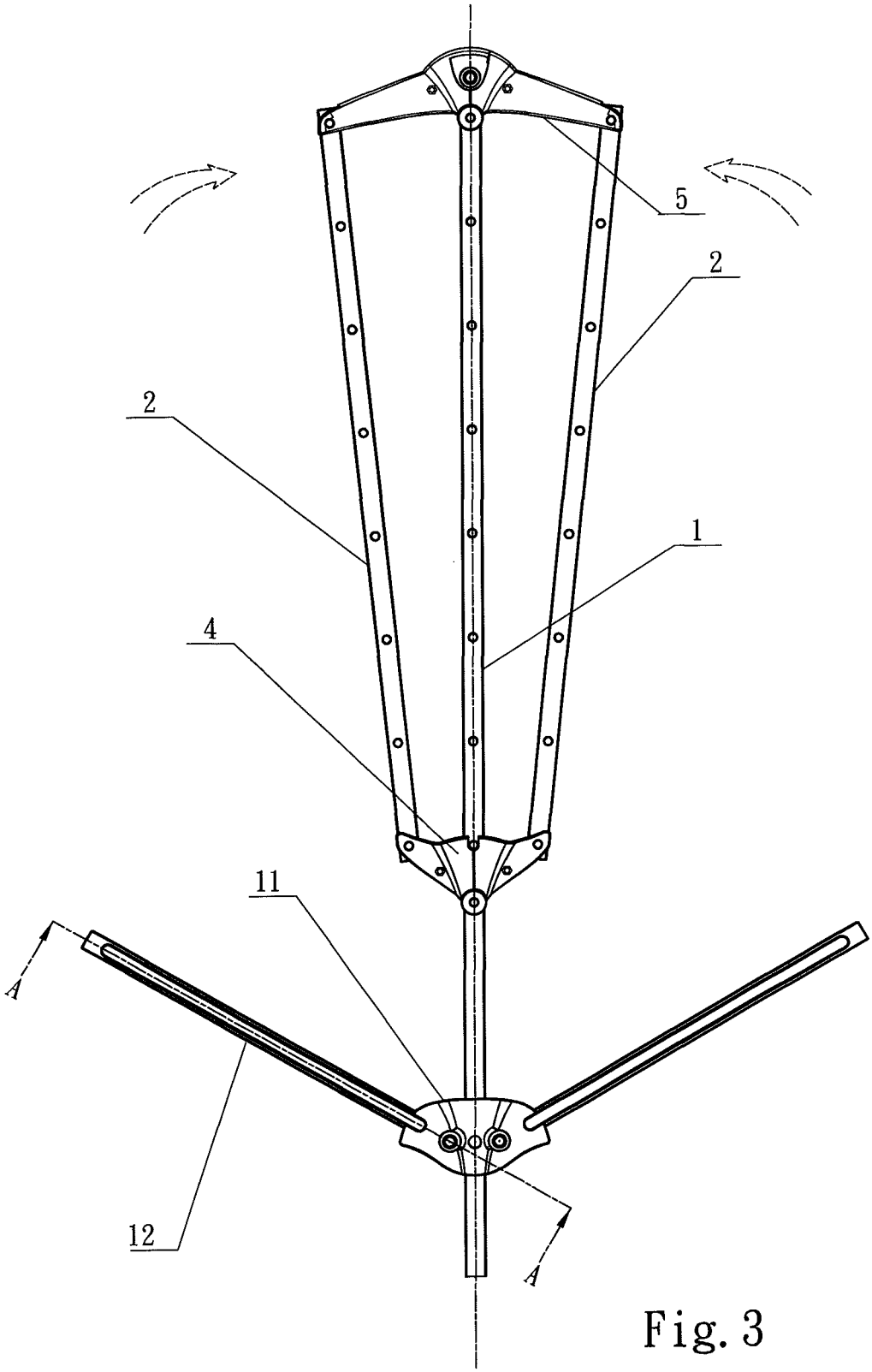
FIG. 3 is a side view of the outdoor antenna according to FIG. 1.
Figure 6:
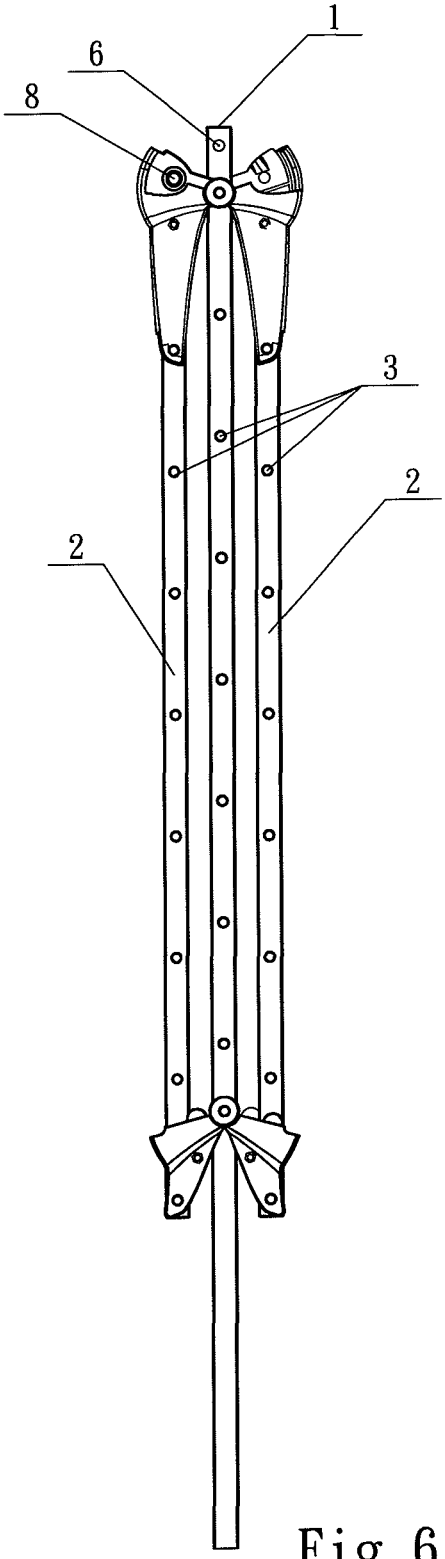
FIG. 6 is a schematic view of the main rod and two assistant rods according to FIG. 3 in a folded condition.

Please refer to FIGS. 1 and 2, the present invention aims to provide an outdoor antenna which comprises a main rod 1 and two assistant rods 2 that are square tubes made of aluminum, and multiple directors 3 that are round tubes located respectively on the main rod 1 and assistant rods 2 and also made of aluminum. The assistant rods 2 are respectively coupled with an inner-swing arm 4 and an outer-swing arm 5 at two ends thereof that are fastened to the main rod 1. The inner-swing arm 4 and outer-swing arm 5 are made of plastics and coupled on the directors 3 and can be swiveled about the directors 3. When the inner-swing arm 4 and outer-swing arm 5 are expanded as shown in FIG. 3, the two assistant rods 2 are fixed on two ends of the main rod 1. The directors are generally distributed in an elongate manner without occupying too much space as shown in FIG. 3 to receive signals. When the inner-swing arm 4 and outer-swing arm 5 are folded as shown in FIG. 6, the two assistant rods 2 are positioned at two sides of the main rod 1 in a parallel manner.

The outer-swing arm 5 includes two parts made from plastics. Each plastic part has side plates 7 clamping two sides of the main rod 1. The side plate 7 has an axle hole 18 coupled on the director 3 at the outmost end of the main rod 1 and can be swiveled about the director 3. The side plate 7 also has a latch hole 8. The main rod 1 has two latch heads 6 at one end thereof. When the outer-swing arm 5 is expanded, the latch heads 6 of the main rod 1 drop into the latch holes 8. As the two assistant rods 2 do not move frequently on the main rod 1, the directors 3 on the main rod 1 and two assistant rods 2 can serve as the rotary axes of the inner-swing arm 4 and outer-swing arm 5 to save four axles. The side plate 7 has an inclined surface 19 on an inner side leading to the latch hole 8. During expansion of the outer-swing arm 5, the inclined surfaces 19 are first in contact with the latch heads 6 of the main rod 1 and move along the inclined angle to press the latch heads 6 of the main rod 1 to be wedged in the main rod 1. Once the latch holes 8 are moved to the positions of the latch heads 6 of the main rod 1, the latch heads 6 of the main rod 1 are dropped into the latch holes 8 to form latching in the expanded state.

The main rod 1 is a square tube with an aperture 9 formed on the side walls. The latch heads 6 of the main rod 1 are located at two ends of a first C-shaped elastic clip 10. The latch heads 6 of the main rod 1 and first C-shaped elastic clip 10 are formed by stamping an elastic metal sheet in an integral structure, and can be expanded towards two sides. Such a structure can be fabricated simpler and also is easier to assemble and install. The first C-shaped elastic clip 10 is located in the square tube. The latch heads 6 of the main rod 1 are ejected outwards from the inner sides of the apertures 9 and exposed outside the square tube. The inner-swing arm 4 is fastened to one of the directors 3 at the inner end of the main rod 1 and can be swiveled about the director 3.

Figure 5:
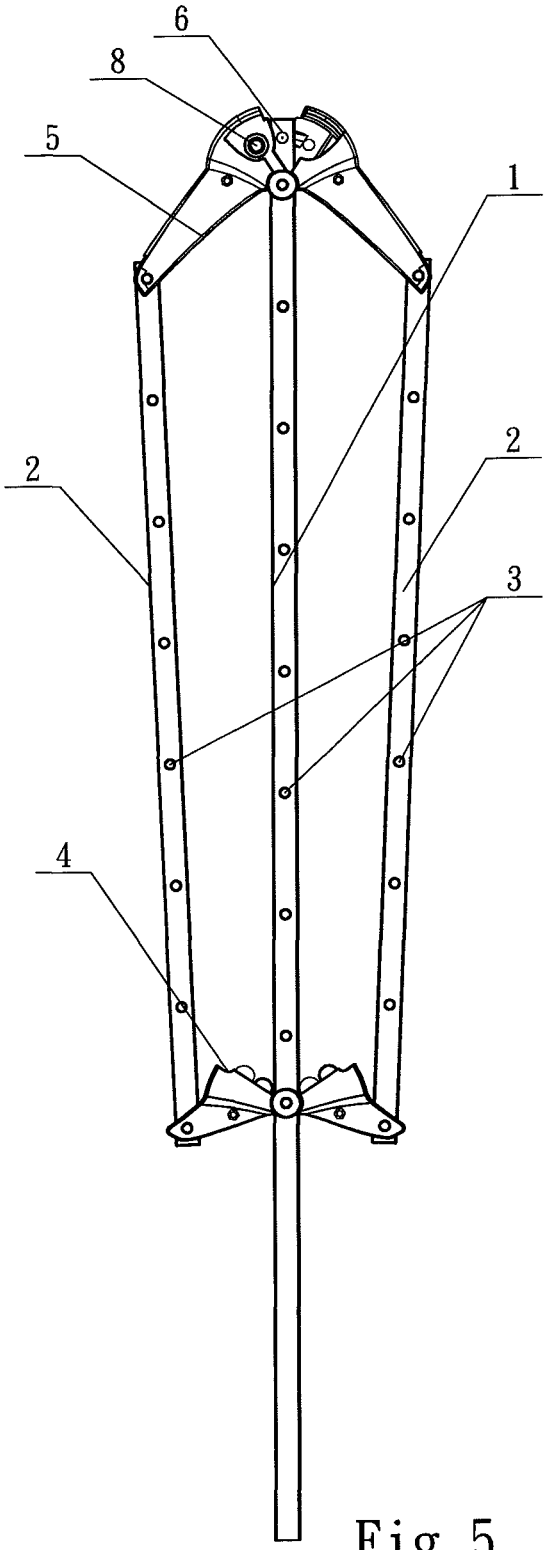
FIG. 5 is a schematic view of the main rod and two assistant rods according to FIG. 3 in an expanded condition.

Please refer to FIG. 5, when the outer-swing arm 5 is expanded, it presses the latch heads 6 of the main rod 1 to retract inwards; once the latch holes 8 on the side plates 7 are moved to the positions of the latch heads 6 of the main rod 1, the first C-shaped elastic clip 10 drives the latch heads 6 of the main rod 1 to eject towards the latch holes 8 and wedge in the latch holes 8. Thereby the outer-swing arm 5 is fixed on the main rod 1 without moving. Thus installation, use and assembly are easier. For disassembly, the latch heads 6 of the main rod 1 are pressed to escape the latch holes 8, so that the outer-swing arm 5 can be swiveled about the director 3 that serves as a rotary axis on the main rod 1. Referring to FIG. 6, the two assistant rods 2 are folded to drive the inner-swing arm 4 and outer-swing arm 5 to turn a selected angle to lean on the lateral sides of the main rod 1 so that the occupied space is reduced to facilitate transportation and storage.

Figure 4:
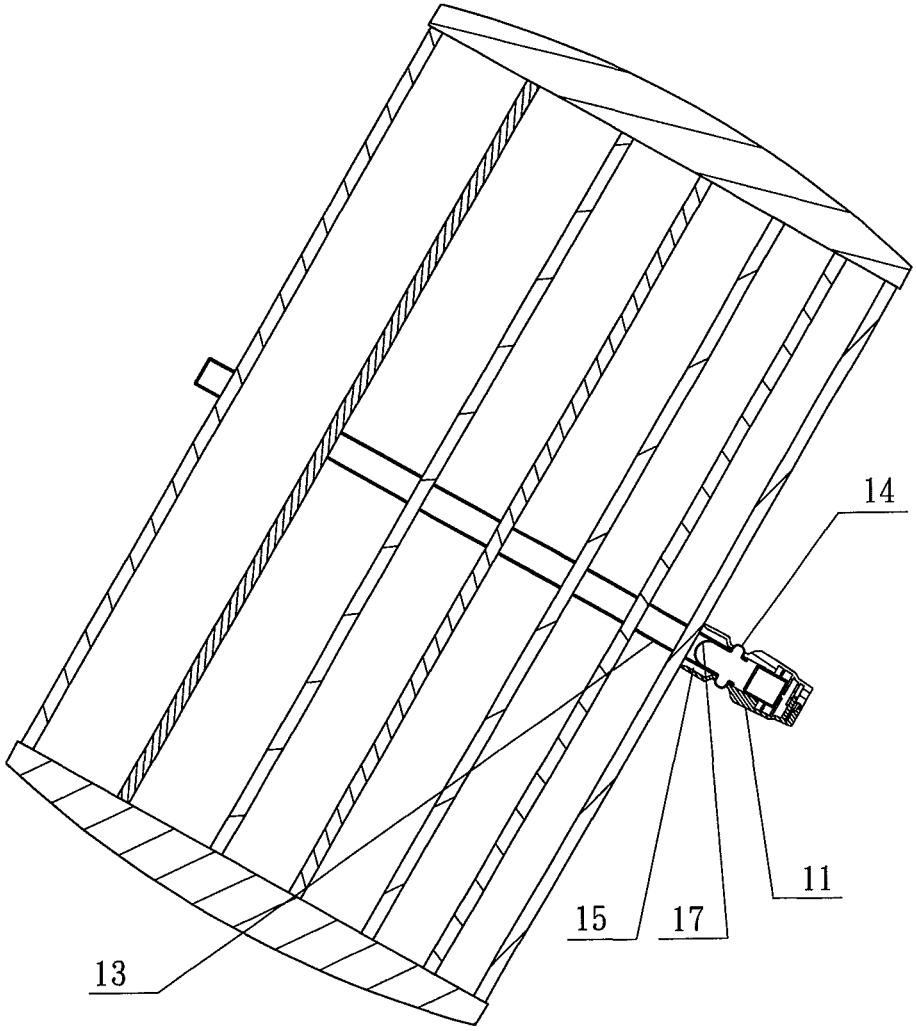
FIG. 4 is a cross section taken on line A-A in FIG. 3.

The main rod 1 also is coupled with a holding rack 11. On the holding rack 11, there are two symmetrical reflectors 12 spaced from each other and distributed in a V shape. Referring to FIGS. 2 and 4, the reflector 12 has a square tube 13 with two latch heads 14. The holding rack 11 has a square hole 15 to hold the square tube 13 and a side orifice 16 on a side wall thereof to hold one latch head 14 of the square tube 13. After the square tube 13 is inserted into the square hole 15, the latch heads 14 of the square tube 13 are wedged in the side orifices 16.

For assembly, the square tube 13 of the reflector 12 is inserted into the square hole 15 of the holding rack 11, and the latch heads 14 of the square tube 13 are then wedged in the side orifices 16, so that the reflector 12 is fixed on the holding rack 11 without moving. Hence installation can be done quickly and easily. For disassembly, the latch heads 14 of the square tube 13 are pressed to escape from the side orifices 16, such that the reflector 12 can be removed easily and quickly from the holding rack 11. The latch heads 14 of the square tube 13 are located at two ends of a second C-shaped elastic clip 17, which are also made by stamping an elastic metal sheet in an integral manner and can be expanded towards two sides. The second C-shaped elastic clip 17 is held in the space inside the square tube 13, and the latch heads 14 of the square tube 13 can be ejected outwards from the inner sides of the apertures 20.

What is claimed is:

1. An outdoor antenna, comprising:

a main rod;

two assistant rods; and multiple directors located respectively on the main rod and the two assistant rods;

wherein the two assistant rods are respectively coupled with an inner-swing arm and an outer-swing arm at two ends thereof that are fastened to the main rod, the inner-swing arm and the outer-swing arm being expanded to allow the two assistant rods to fix at two ends of the main rod and folded to allow the two assistant rods to position in parallel with the main rod; and wherein the main rod includes two latch heads ejecting outward from the main rod, the outer-swing arm eluding a plurality of side plates located at two sides of the main rod, each aide plate including a latch hole disposed thereon and an inclined surface formed on an inner side thereof leading to the latch hole, the inclined surface contacting with the latch head and gradually pressing the latch head to be wedged in the main rod during expansion of the outer-swing arm, and the latch head being dropped into the latch hole from the latching in the expanded state once the latch hole is moved to the position of the latch head.

2. The outdoor antenna of claim 1, wherein the side plate is fastened to one director located at an outmost end of the main rod and swivelable about the director.

3. The outer antenna of claim 2, wherein the main rod is a square tube which includes an aperture on a side wall thereof, the two latch heads of the main rod being located at two ends of a first C-shaped elastic clip which is held in the square tube, the two latch heads of the main rod being ejected outwards from inner sides of the apertures and exposed outside of the square tube.

4. The outdoor antenna of claim 2, wherein the inner-swing arm is fastened to one director at an inner end of the main rod and swivelable about the director.

5. The outdoor antenna of claim 3, wherein the inner-swing arm is fastened to one director at an inner end of the main rod and swivelable about the director.

6. The outdoor antenna of claim 1, wherein the main rod includes a holding rack to hold a reflector.

7. The outdoor antenna of claim 6, wherein the reflector includes a square tube which includes two latch heads, the holding rack including a square hole to hold the square tube and a side orifice on a side wall thereof to hold one latch head of the square tube, the two latch heads of the square tube being wedged in the side orifices when the square tube is inserted into the square hole.

8. The outer antenna of claim 7, wherein the two latch heads of the square tube are located at two ends of a second C-shaped elastic clip which is held in the square tube and ejected outwards from inner sides of apertures on the square tube.

* * * * *